US010245199B2

(12) United States Patent
Wakabayashi et al.

(10) Patent No.: US 10,245,199 B2
(45) Date of Patent: Apr. 2, 2019

(54) INCUBATOR

(71) Applicant: ATOM MEDICAL CORPORATION, Bunkyo-ku, Tokyo (JP)

(72) Inventors: Keisuke Wakabayashi, Saitama (JP); Masato Honda, Saitama (JP); Yutaka Sekiguchi, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 79 days.

(21) Appl. No.: 15/359,056

(22) Filed: Nov. 22, 2016

(65) Prior Publication Data

US 2017/0143570 A1 May 25, 2017

(30) Foreign Application Priority Data

Nov. 25, 2015 (JP) ..... 2015-229321

(51) Int. Cl.
*A61G 11/00* (2006.01)

(52) U.S. Cl.
CPC ..... *A61G 11/006* (2013.01)

(58) Field of Classification Search
CPC .... A61G 11/00; A61G 11/005; A61G 11/006; A61G 11/001–11/004; A61G 11/007–11/009
See application file for complete search history.

(56) References Cited

U.S. PATENT DOCUMENTS 6,049,924 A * 4/2000 Prows ..... A61G 11/00 5/427
6,231,499 B1 * 5/2001 Jones ..... A61G 11/00 600/22

FOREIGN PATENT DOCUMENTS

CN 106974791 A 7/2017
EP 3 167 862 A1 5/2017
JP 2012-223320 A 11/2012

OTHER PUBLICATIONS

Office Action in corresponding European Application No. 16200050.9, dated Jul. 14, 2017, 4 pages.
Office Action in China application 201611045153.3, dated Sep. 18, 2018, pp. 1-10.

* cited by examiner

*Primary Examiner* — Carrie R Dorna
(74) *Attorney, Agent, or Firm* — Brinks Gilson & Lione

(57) ABSTRACT

An incubator is provided in which a latch receiving portion is disposed in one of an incubator base or baby guards, a latch portion is disposed in the other of the incubator base or the baby guards, and the latch portion is configured to be unlatched by turning an operable member forward and then linearly moving the operable member forward.

7 Claims, 7 Drawing Sheets

INCUBATOR

RELATED APPLICATIONS

This application claims priority under 35 U.S.C. § 119 to Japanese Patent Application No. 2015-229321 filed on Nov. 25, 2015, the entire content of which is hereby incorporated by reference.

BACKGROUND OF THE INVENTION

1. Field of the Invention

The present disclosure relates to an incubator equipped with a mattress tray on which an infant may be laid, an incubator base on which the mattress tray is disposed, and at least one guard wall portion that surrounds at least part of the vicinity of the outer periphery of the mattress tray.

2. Description of the Related Art

Japanese Patent Application Laid-open (JP-A) No. 2012-223320 discloses an open type incubator in which a flat container-like mattress tray is disposed on an incubator base. Furthermore, a head-side fixed wall portion (i.e., fixed baby guard) typically configuring a wall portion at the head side of an infant, a foot-side movable wall portion (i.e., movable baby guard) typically configuring a wall portion at the foot side of the infant, a left movable wall portion (i.e., movable baby guard) typically configuring a wall portion at the left side of the infant, and a right movable wall portion (i.e., movable baby guard) typically configuring a wall portion at the right side of the infant are disposed on the mattress tray so as to form a substantially rectangular shape overall in plan view. An infant accommodation space that is substantially cuboid in shape with an open upper side is configured by the mattress tray (in other words, a mattress on the mattress tray) and by the one fixed baby guard and three movable baby guards, each of which may be substantially rectangular in shape and may be substantially transparent. Each of the three movable baby guards and one fixed baby guard is entirely configured by a substantially transparent plastic panel. Each of the three movable baby guards is configured to be swingable back and forth between an upright state, in which the movable baby guard points substantially upward and is substantially upright (hereinafter called "the upright state"), and a downward hanging state, in which the movable baby guard hangs substantially downward (hereinafter called "the downward hanging state"), using as a pivot center pivot support shafts located at both its left and right sides or both its front and rear sides and disposed in the vicinity of the section at the lower edge side of the movable baby guard in the upright state.

However, in the incubator of JP-A No. 2012-223320, the structure of the baby guard attachment mechanism for attaching the movable baby guards and the fixed baby guard to the incubator base is complex. Consequently, the operator has needed to perform a complex baby guard detachment operation in order to detach the movable baby guards and the fixed baby guards from the incubator base.

SUMMARY OF THE INVENTION

The present disclosure has been made in order to effectively address the aforementioned shortcomings in the conventional incubator with a relatively simple configuration.

An aspect of the present disclosure is an incubator including: a mattress tray on which an infant is laid; an incubator base on which the mattress tray is disposed; at least one baby guard that is configured to surround at least part of the vicinity of the outer periphery of the mattress tray; a latch receiving portion that is disposed in either one of the incubator base or the at least one baby guard; and a latch portion that is disposed in the other of the incubator base or the at least one baby guard, the latch portion being configured to move back and forth in a substantial axial direction of the latch portion relative to the at least one baby guard; and an operable member for operating the latch portion, the operable member is configured such that the operable member is placed into a state in which substantially linear forward movement is allowed as a result of the operable member being turned in one way, and the latch portion is unlatched from the latch receiving portion as a result of substantially linearly moving the operable member forward in this state.

By configuring the incubator in this way, the latch portion is configured to be unlatched from the latch receiving portion by turning, from a latched state in which the operable member has not yet been operated, the operable member forward and thereafter substantially linearly moving the operable member in forth direction. Therefore, even if an external force or shock not intended by the operator is applied to the operable member, there is virtually no concern that the baby guard will unexpectedly be unlatched, and there is virtually no concern that the baby guard will be unexpectedly detached from the incubator base and, consequently, there is also virtually no concern that the baby guard will become damaged. Moreover, the operator may easily see whether or not the operable member is returned.

In the aspect of the disclosure, the operable member may be disposed at the at least one baby guard.

By configuring the incubator in this way, when the operator detaches the baby guard, the operator needs to tightly take hold of the baby guard. For this reason, there is little concern that by wrongly taking hold of the baby guard the operator will cause the baby guard to fall out resulting in the baby guard being damaged.

In the aspect of the disclosure, the at least one baby guard may be configured such that, in a state in which the latch portion is latched by the latch receiving portion, the at least one baby guard is able to individually swing back and forth, using the latch portion as a pivot point, between a state in which the at least one baby guard is directed substantially upward and is substantially upright and a state in which the at least one baby guard is directed substantially downward and hangs substantially downward.

By configuring the incubator in this way, since the baby guard is pivotally supported, in such a way that it is able to swing back and forth, by the latch portion of a latch mechanism for latching the baby guard, the baby guard is able to be placed in a state in which the baby guard is directed substantially downward and is not substantially upright by means of a relatively simple structure.

Furthermore, in the aspect of the disclosure, the at least one baby guard may include plural baby guards that is configured to surround the vicinity of the outer periphery of the mattress tray, a first baby guard among the plural baby guards may include a grommet portion, and may be configured to be detachably attached to a first attachment place disposed in the vicinity of the outer periphery of the mattress tray, a second baby guard among the plural baby guards may be configured to be detachably attached to a second attachment place disposed in the vicinity of the outer periphery of the mattress tray, the first baby guard may be further configured to be detached from the first attachment place and attached to the second attachment place, and the second baby guard may be further configured to be detached from the second attachment place and attached to the first attachment place.

By configuring the incubator in this way, since the first baby guard equipped with the grommet portion and the second baby guard not equipped with the grommet portion exchangeable with each other, the first baby guard may be attached to a location convenient for a doctor or nurse. For this reason, there is virtually no concern that a breathing tube will be twisted and/or bent due to the infant moving his/her own body. Furthermore, if the first baby guard or the second baby guard is damaged, at least one baby guard among the first baby guard and the second baby guard may be replaced as needed with a spare baby guard. Moreover, since the first baby guard is equipped with the grommet portion and the second baby guard is not equipped with the grommet portion, plural baby guards may be provided relatively inexpensively in comparison to a case in which the first baby guard and the second baby guard are both equipped with a grommet portion.

In the aspect of the disclosure, the at least one baby guard may include a front baby guard that is the second baby guard, a rear baby guard that is the first baby guard, a left baby guard, and a right baby guard.

By configuring the incubator in this way, an incubator having a relatively simple structure and which is also relatively easy to handle may be provided.

In the aspect of the disclosure, wherein an infant accommodation space that is substantially rectangular in shape in plan view, may be configured by the at least one baby guard.

By configuring the incubator in this way, an incubator having a relatively simple structure and which is relatively easy to handle when simultaneously handling numerous incubators may be provided.

In the aspect of the disclosure, the incubator may be an open type incubator.

Since the incubator is an open type incubator, an incubator having a simple structure and which is relatively easy to handle may be provided.

The above and other objects, features, and advantages of the present disclosure will be readily apparent from the detailed description set forth below when taken in conjunction with the accompanying drawings.

DETAILED DESCRIPTION OF THE PREFERRED EMBODIMENTS

Next, an embodiment in which the disclosure is applied to an open type incubator (i.e., infant warmer) will be described with reference to the drawings.

1. General Description of Incubator Overall

Figure 1:
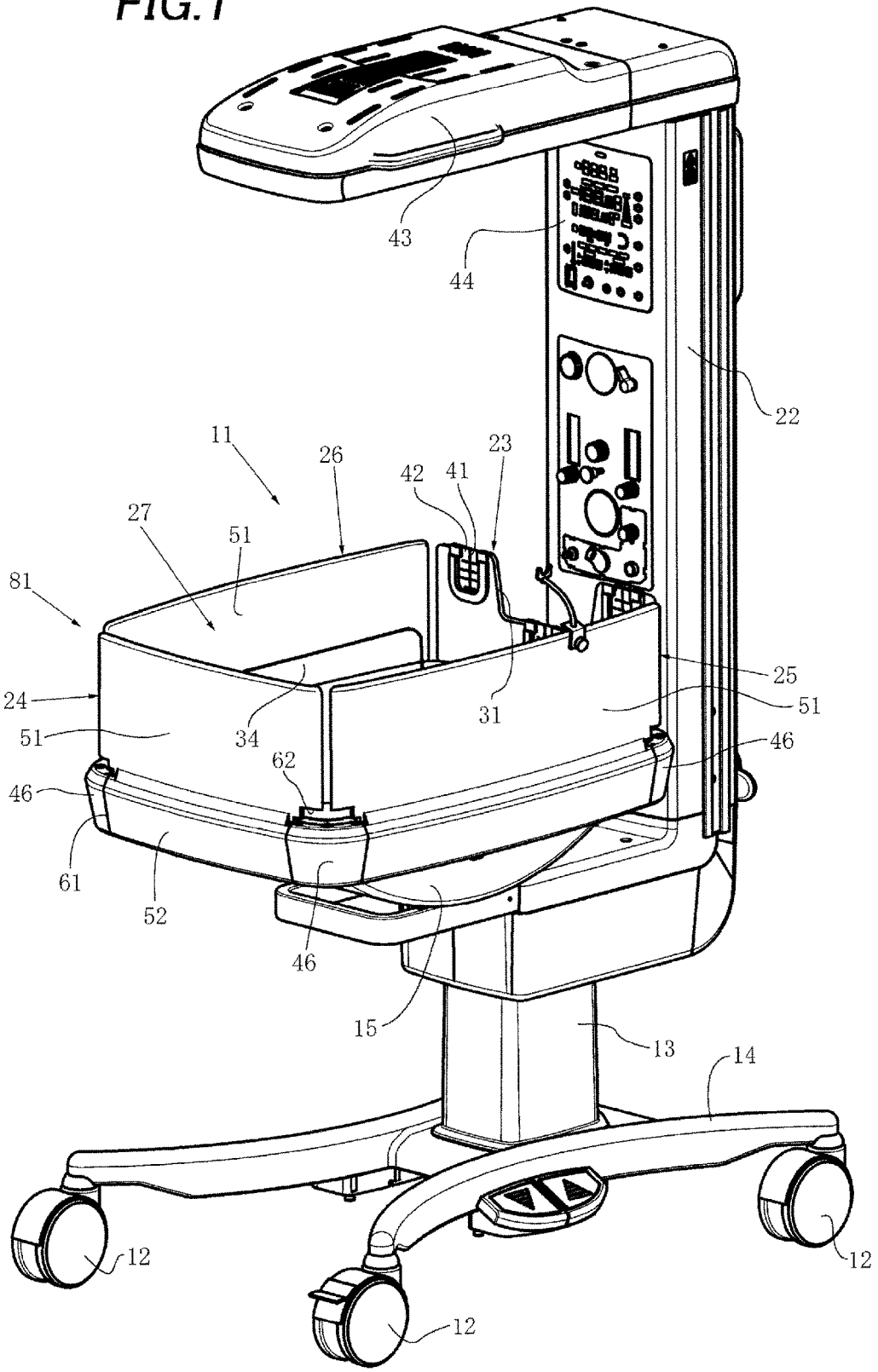
FIG. 1 is a perspective view of an open type incubator in an embodiment to which the disclosure has been applied, in a normal use state.
Figure 2:
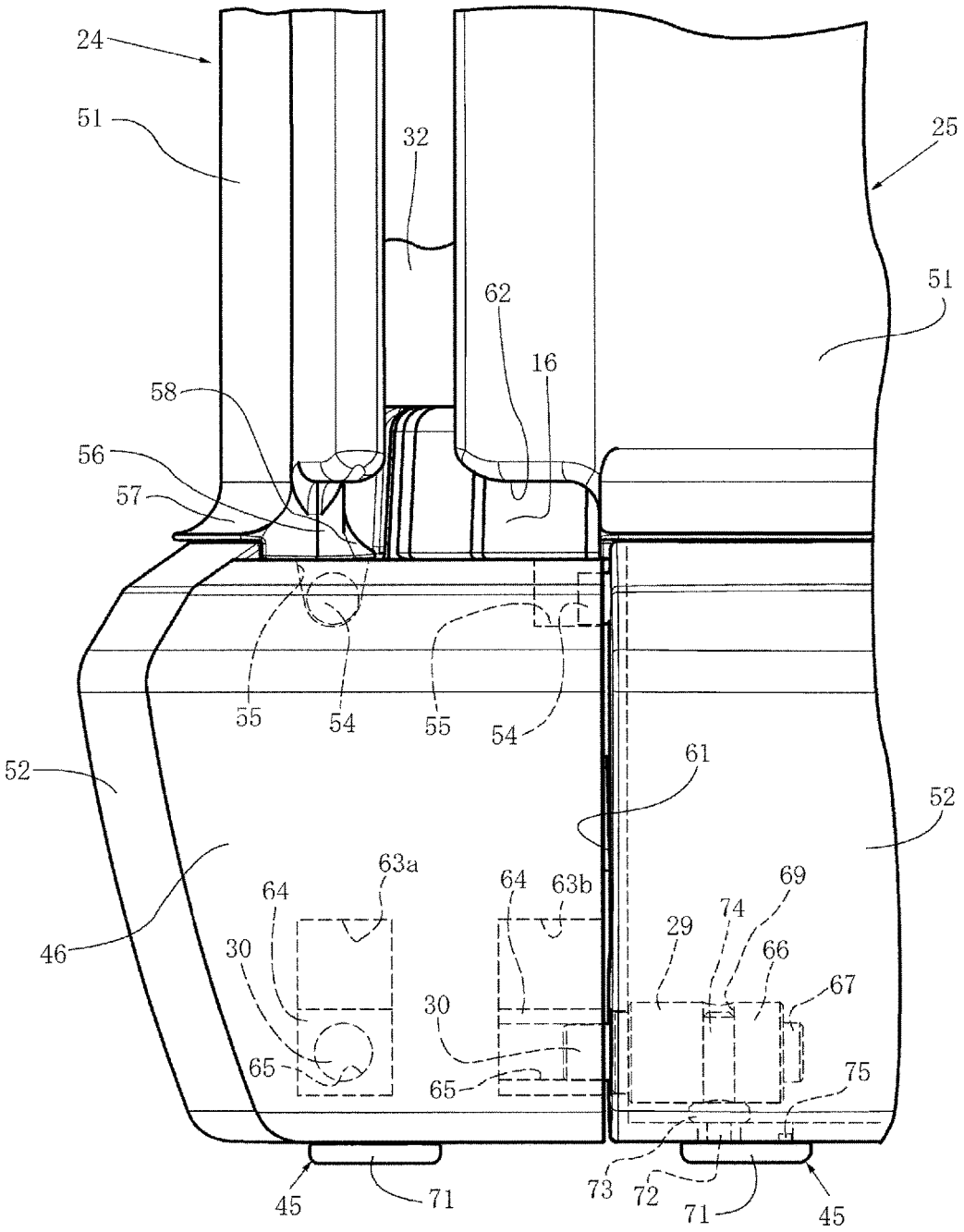
FIG. 2 is a side view of the vicinity of the lower section of a corner portion at the front side and the left side of an infant accommodation mechanism of the open type incubator shown in FIG. 1, as viewed substantially from the front.
Figure 5:
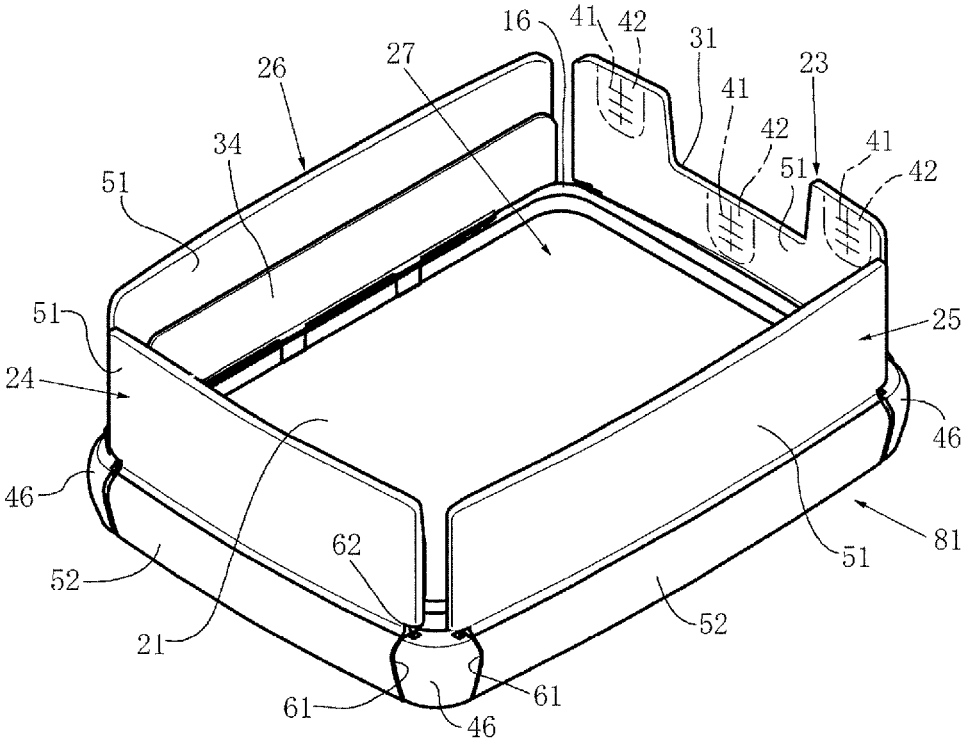
FIG. 5 is a perspective view of the infant accommodation mechanism of the open type incubator shown in FIG. 1.

As shown in FIG. 1, an open type incubator 11 is equipped with a trolley 14 to which wheels 12 and a main strut 13 are attached. Specifically, the wheels 12 are attached under four corners of the trolley 14, and the main strut 13 is attached on the trolley 14. An incubator base 15 is disposed on the main strut 13. As shown in FIG. 1, FIG. 2, FIG. 5 and other drawings, a flat container-shape mattress tray 16 is disposed on the incubator base 15. A mattress 21 on which an infant such as a newborn infant may be laid is placed on the mattress tray 16.

As shown in FIG. 1 and FIG. 2, on the mattress tray 16, which is attached and secured to and disposed on the incubator base 15, an outer wall portion (an outer baby guard) 23 located adjacent to an accessory support column 22 disposed on the main strut and configuring an outer wall portion at the head side of the infant or the rear side, an outer wall portion 24 configuring an outer wall portion at the foot side of the infant or the front side, an outer wall portion 25 configuring an outer wall portion at the left side of the infant, and an outer wall portion 26 configuring an outer wall portion at the right side of the infant are disposed so as form a substantially rectangular shape in plan view. An infant accommodation space 27 that is substantially cuboid in shape with an open upper side is configured by the mattress tray 16 (in other words, the mattress 21) and by the outer wall portions 23 to 26, each of which may be substantially rectangular in shape and may be substantially transparent. The left outer wall portion 25 and the right outer wall portion 26 may be substantially identical to each other in dimension. The outer wall portion 23 and the outer wall portion 24, whose lengths in their respective length directions (in other words, the horizontal direction) are somewhat smaller in comparison to those of the outer wall portions 25 and 26, may be substantially identical to each other in dimension excluding the fact that a cutout-like recess portion 31 is disposed so as to extend from the substantial central section of the upper edge portion of the outer wall portion 23 part of the way toward the lower edge portion. Each of the outer wall portions 23 to 26 may be substantially configured by a panel made of a substantially transparent plastic such as a substantially transparent polycarbonate resin or a substantially transparent acrylic resin.

Figure 3A:
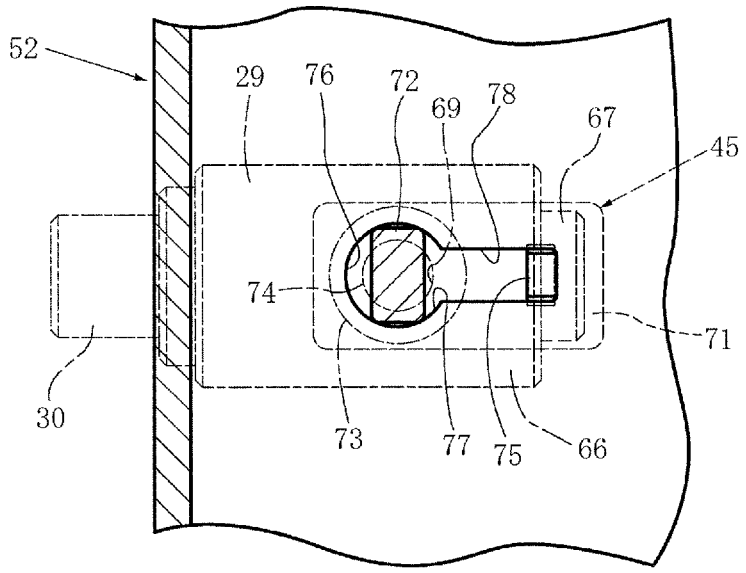
FIG. 3A is a partial transverse sectional view of an operable mechanism for wall portion attachment and detachment shown in FIG. 2, in a state in which an operable member has not yet been operated.
Figure 3B:
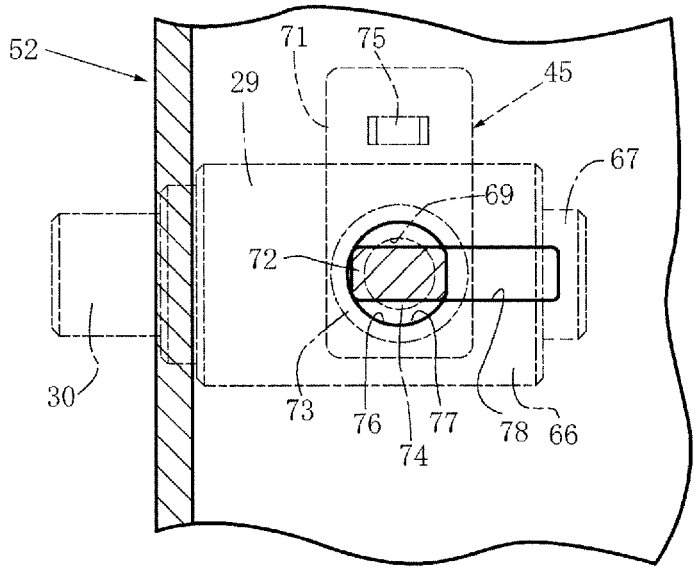
FIG. 3B is the same transverse sectional view as FIG. 3A, in a first operational state of the operable member of the operable mechanism for wall portion attachment and detachment shown in FIG. 3A.
Figure 3C:
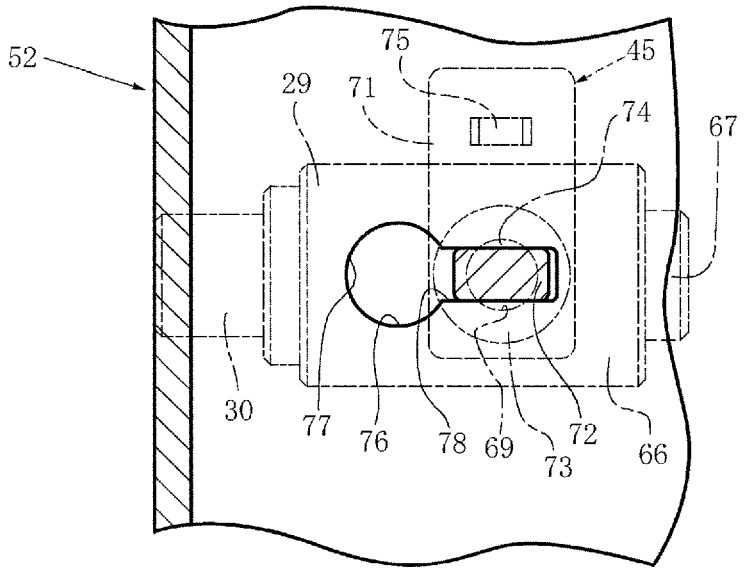
FIG. 3C is the same transverse sectional view as FIG. 3A, in a second operational state of the operable member of the operable mechanism for wall portion attachment and detachment shown in FIG. 3A.
Figure 4A:
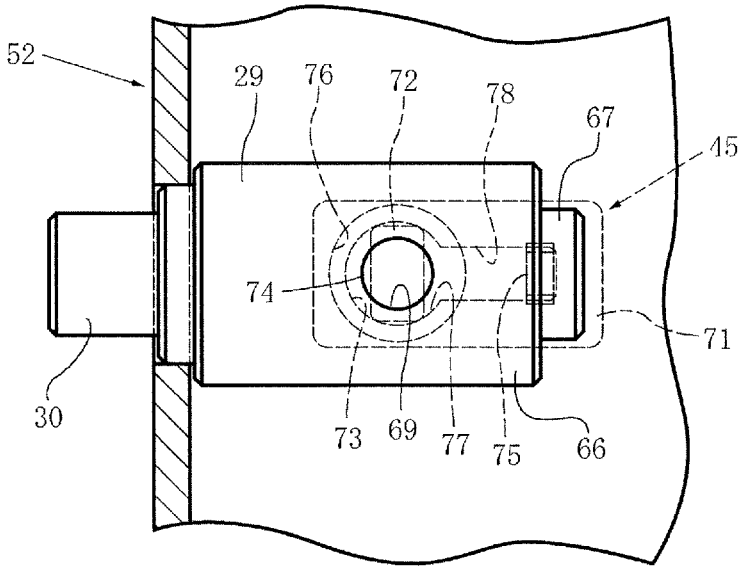
FIG. 4A is a partial sectional view of the operable mechanism for wall portion attachment and detachment shown in FIG. 3A, in a state in which a spindle body is indicated by a solid line.
Figure 4B:
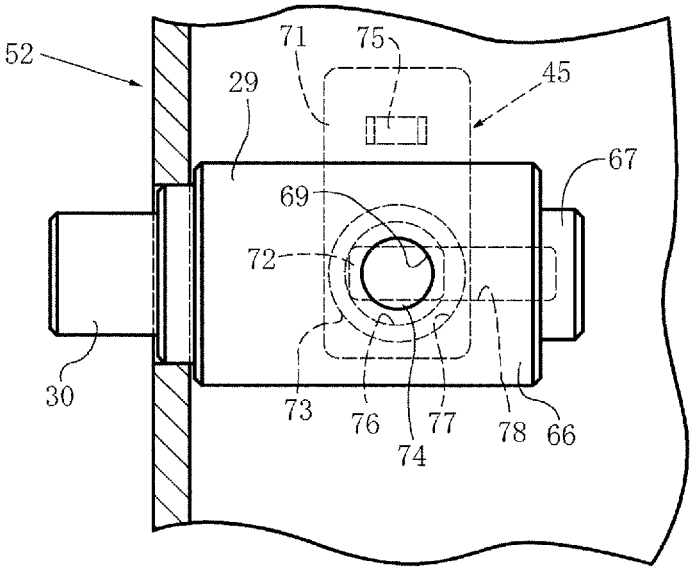
FIG. 4B is a partial sectional view of the operable mechanism for wall portion attachment and detachment shown in FIG. 3B, in a state in which the spindle body is indicated by a solid line.
Figure 4C:
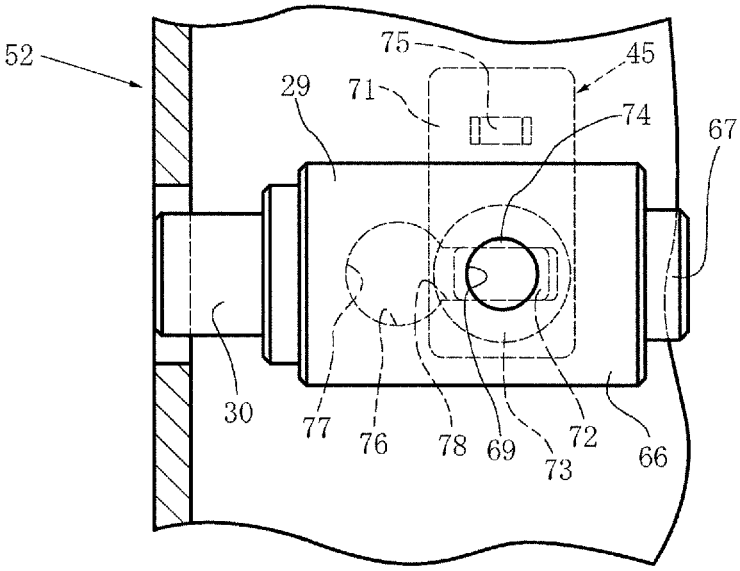
FIG. 4C is a partial sectional view of the operable mechanism for wall portion attachment and detachment shown in FIG. 3C, in a state in which the spindle body is indicated by a solid line.
Figure 7:
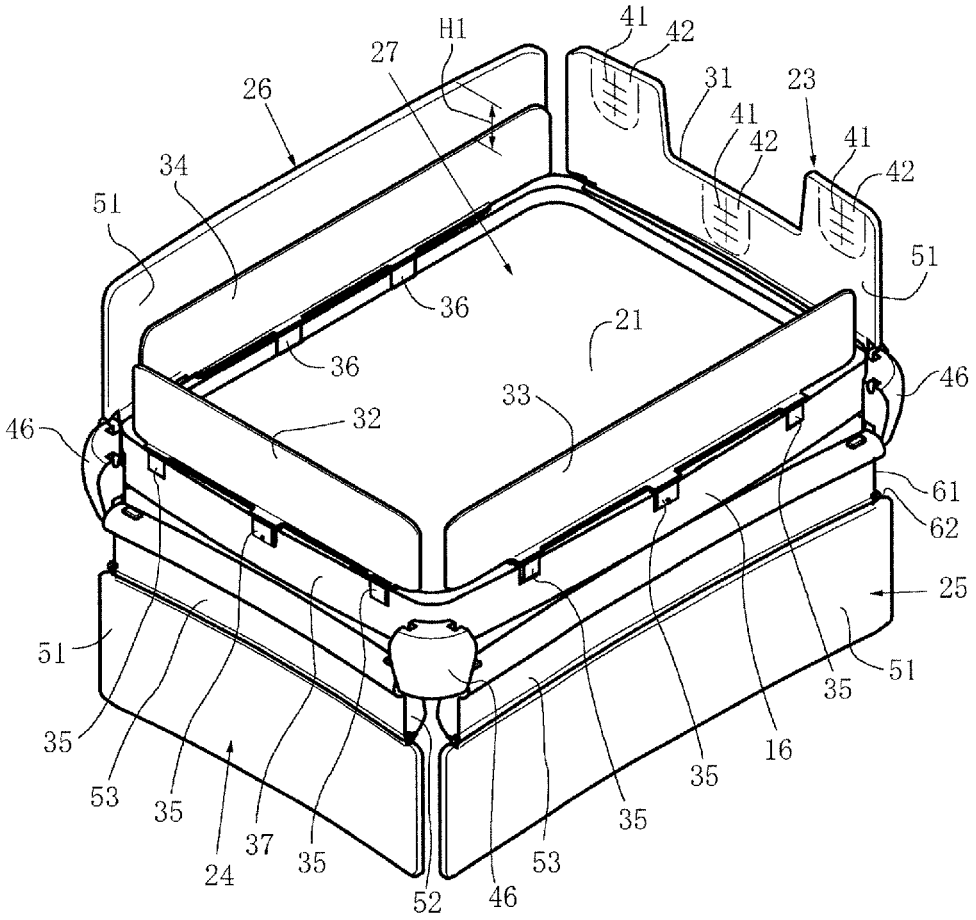
FIG. 7 is a perspective view of the infant accommodation mechanism shown in FIG. 5, in a state in which the foot-side outer wall portion and a left outer wall portion have been opened.

Each of the outer wall portions 24 to 26 is configured to be swingable back and forth between an upright state, in which the outer wall portion points substantially upward and is substantially upright as shown in FIG. 1 and FIG. 2 (hereinafter called "the upright state"), and a downward hanging state, in which the outer wall portion hangs substantially downward as shown in FIG. 7 (hereinafter called "the downward hanging state"; however, in FIG. 7, the outer wall portion 26 is shown in the upright state), using as a pivot center spindle portions (in other words, latch portions) 30 of pivot spindle members (in other words, latch members) 29 located on its left and right sides or its front and rear sides and disposed in the vicinity of the section on the lower edge side of the outer wall portion in the upright state. The outer wall portion 23 is also pivotally supported by spindle portions (not shown in the drawings) located on its left and right sides, in the similar way as the outer wall portion 24. When an operator manually moves an operable member 45 forward, the spindle portion 30 shown in FIG. 2, FIG. 3A to FIG. 3C, and FIG. 4A to FIG. 4C may be moved forward from a state in which the spindle portion 30 is engaged with an attachment member (in other words, an attachment portion) 46 as shown in FIG. 2, FIG. 3A, and FIG. 4A, through an intermediate state as shown in FIG. 3B and FIG. 4B, to a state in which the spindle portion 30 is not engaged with the attachment member 46 as shown in FIG. 3C and FIG. 4C. When the operator manually moves the operable member 45 in the non-engaged state backward, the spindle portion 30 may be moved and returned to the engaged state reversely to the forward moving operation.

As shown in FIG. 7, for example, three inner wall portions 32, 33, and 34 are disposed along the outer periphery of the mattress tray 16 so as to form a substantially U-shape overall when viewed in plan. Each of the inner wall portions 32 to 34 may be substantially configured by a panel made of a substantially transparent plastic such as a polycarbonate resin or an acrylic resin. The foot-side inner wall portion 32 may be detachably attached to the mattress tray 16 so as to project substantially upward from the vicinity of the end portion at the foot side of the mattress tray 16. Furthermore, the left and right inner wall portions 33 and 34 may be detachably attached to the mattress tray 16 so as to project substantially upward from the end portions at the left side and right side of the mattress tray 16.

As shown in FIG. 1 and the other drawings, an appropriate number (in this embodiment, three) of grommet members (i.e., grommet portions) 42 having incisions 41 for holding cables may be attached to the section of the outer wall portion 23 adjacent to the lower end of the cutout-like recess portion 31 and the sections of the outer wall portion 23 adjacent to the left and right ends of the recess portion 31. Elongate members (not shown in the drawings) such as an oxygen supply tube may be held in the incisions 41 in a state in which these members have been passed through the grommet members 42. An infrared heater 43 is disposed at the upper end portion of the accessory support column 22. Moreover, various measuring/control unit 44 such as for measuring or controlling body temperature or $SpO_2$ are disposed at the accessory support column 22 so as to be substantially positioned between the infrared heater 43 and the infant accommodation space 27 when viewed from the front. Specifically, the body temperature control unit of these measuring/control unit 44 may be configured such way it may be input signals from a body temperature probe that measures the body temperature of the infant and may display the body temperature, or such that it may control the heating temperature of the infrared heater 43.

2. Inner Wall Portion Structure

Figure 6:
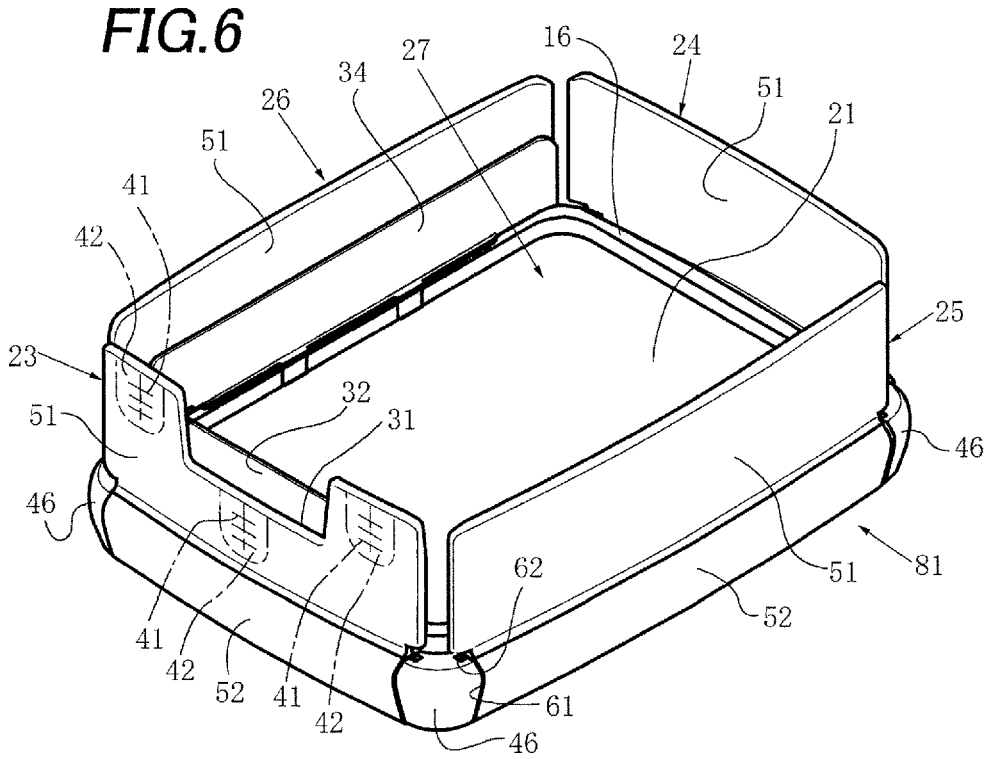
FIG. 6 is a perspective view, in a state in which a head-side outer wall portion and a foot-side outer wall portion have been interchanged with each other and attached, of the infant accommodation mechanism shown in FIG. 5.

As shown in FIG. 5 to FIG. 7, the foot-side inner wall portion 32 may extend across the substantially entire length of the vicinity of the end portion at the foot side of the mattress tray 16. The left inner wall portion 33 may extend across the substantially entire length of the vicinity of the end portion at the left side of the mattress tray 16. The right inner wall portion 34 may extend across the substantially entire length of the vicinity of the end portion at the right side of the mattress tray 16. The left and right end portions of the inner wall portion 32 are separated from the front end portions of the inner wall portions 33 and 34 and, thus, the inner wall portions 32 to 34 are configured as individual parts. However, the left and right end portions of the inner wall portion 32 may also be connected to the front end portions of the inner wall portions 33 and 34. In this case, the inner wall portions 32 to 34 may be configured as a substantially U-shaped single frame body overall. Each of the inner wall portions 32 to 34 may be equipped with projecting portions 35 for attachment that project downward, and may be substantially L-shaped.

Specifically, as shown in FIG. 7, for example three projecting portions 35 for attachment that project downward are disposed at the outer surface of each of the inner wall portions 32 to 34 by integral molding or the like with the inner wall portions 32 to 34. For example, two projecting portions 36 for attachment that project downward are disposed at the inner surface of each of the inner wall portions 32 to 34 by integral molding or the like with the inner wall portions 32 to 34. When the inner wall portions 32 to 34 are attached to a side wall portion 37 of the mattress tray 16, the projecting portions 35 and the projecting portions 36 of the inner wall portions 32 to 34 abuttingly contact the outer surface and the inner surface, respectively, of the side wall portion 37 of the mattress tray 16. For this reason, the side wall portion 37 is sandwiched from both sides by the projecting portions 35 and the projecting portions 36, so the inner wall portions 32 to 34 are detachably attached and secured to the side wall portion 37 of the mattress tray 16.

3. Configuration of Outer Wall Portion Structure

As shown in FIG. 1, FIG. 2, and FIG. 7, each of the outer wall portions 23 to 26 is equipped with a wall portion body 51 and a support member 52 to which the substantial lower end portion of the wall portion body 51 is secured by screws (not shown in the drawings). The substantial entire inner surface of the substantial lower end portion of the wall portion body 51 is covered by a cover member 53. The outer wall portions 23 to 26 are swingably attached to the attachment members 46 by the pairs of spindle portions 30 in the vicinities of both the left and right or front and rear end portions of the lower end portions of the support members 52 of the outer wall portions 23 to 26. The attachment members 46 are attached and secured to the substantially four corners of the mattress tray 16. A left and right pair of bearing guide portions 63*a* and 63*b* configured by recess portions that are long and narrow in the substantially vertical direction are formed in the inside surface of the left and right sides of each of the attachment members 46. A bearing member 64 that may be substantially cuboid in shape is accommodated, in such a way that the bearing member 64 is able to move substantially up and down (in other words, able to be moved substantially up and down at will), in each of the left and right pair of bearing guide portions 63*a* and 63*b*. A through hole 65 or a blind hole that may extend in the substantially horizontal direction and has a longitudinal cross section that may be substantially circular in shape is formed as a bearing portion in each of the bearing members 64. A left and right pair of pivot spindle guide portions (not shown in the drawings), which may be configured by recess portions that are long and narrow in the substantially left and right direction and are substantially solid cylindrical in shape, are formed by integral molding or the like at the inner surface at the left and right sides of each of the support members 52.

As shown in FIG. 3A, FIG. 4A and the other drawings, a spindle body 66 of each of the spindle portions 30 may be long and narrow in the left and right direction and substantially solid cylindrical in shape. A spring-catching projecting portion 67 is projectingly disposed at the side end surface of the spindle body 66 at the opposite side of the spindle portion 30. A spring (not shown in the drawings) having one end portion thereof engaged with the projecting portion 67 elastically urges the pivot spindle member 29 toward the substantially left side in FIG. 3A. The operable member 45 has a large knob portion 71, which may have a substantially rectangular shape, for turning and sliding the operable member 45. A lock portion 72 that may have a substantially rectangular shape is connectedly disposed by integral molding or the like at the knob portion 71. A retention portion 73 that may be substantially circular in shape is connectedly disposed by integral molding or the like at the lock portion 72. An engaging shaft portion 74 that may have a long and narrow substantial solid cylindrical shape is connectedly disposed by integral molding or the like at the retention portion 73. An engagement hole 69 that may be a through hole or a blind hole is formed in the spindle body 66 so as to extend in the substantially vertical direction in FIG. 2. The engaging shaft portion 74 is turnably (in other words, rotatably) fitted into the engagement hole 69. At the inner surface of the knob portion 71, a turn stopper portion 75 that may be a substantially trapezoidal tabular portion when viewed from the substantially right side in FIG. 3A and FIG. 4A is connectedly disposed by integral molding or the like. A through hole (in other words, a guiding engaged hole or a guiding engaged portion) 76 that may have a substantially keyhole shape is formed in the support member 52. The through hole 76 may be configured in a substantial keyhole shape in which a first open portion 77 having a substantially circular shape and a second open portion 78 having a substantial rectangular shape that is continuous with the first open portion 77 are integrated. The guiding engaged hole 76 does not necessarily need to be a through hole and may also be a blind hole, for example.

As shown in FIG. 2, FIG. 7 and other drawings, a pair of connecting members 54 disposed at both side end portions in the substantial longitudinal direction of each of the outer wall portions 23 to 26 are detachably engaged with a pair of engaged portions 55 disposed at both side end portions in the substantially horizontal direction of each of the attachment members 46. The lower end portion of the wall portion body 51 of each of the outer wall portions 23 to 26 extends part of the way downward beyond an intermediate position in the substantially vertical direction of each of the support members 52. As shown in FIG. 1, FIG. 2 and the other drawings, the section of the wall portion body 51 of each of the outer wall portions 23 to 26 adjacent from above to the upper surface of each of the support members 52 is configured as a thick-walled portion 56 having a longitudinal cross section that is substantially triangular in shape. The thick-walled portion 56 is disposed across the substantially entire length in the substantially horizontal direction (i.e., the substantial length direction) of each of the outer wall portions 23 to 26. Consequently, in order to prevent dirty water, dust, and the like from getting between the lower end portion of the wall portion body 51 and the support member 52 and between that lower end portion and the cover member 53, one side portion 57 of the lower end surface of both side sections in the thickness direction of the thick-walled portion 56 abuttingly contacts the substantial upper surface of the support member 52, and the other side portion 58 of the lower end surface abuttingly contacts the substantial upper surface of the cover member 53.

As shown in FIG. 1, FIGS. 5 to 7 and the other drawings, the outer wall portion 23 may be substantially identical in shape to the foot-side outer wall portion 24 excluding the fact that the outer wall portion 23 has the cutout-like recess portion 31 and the grommet members 42. The left outer wall portion 25 may be substantially identical in shape to the right outer wall portion 26. In order to configure clearance portions with respect to the four attachment members 46, missing portions 61 are disposed in the sections of both end portions of the support member 52 of each of the outer wall portions 23 to 26 corresponding to the attachment members 46. Consequently, the length in the substantial horizontal direction of each of the support members 52 is configured to be slightly shorter than the length in the substantial horizontal direction of the wall portion body 51 of each of the outer wall portions 23 to 26. A missing portion 62 that is continuous with the missing portion 61 is also disposed in the vicinity of the lower end portion at both the left and right sides or both the front and rear sides of the wall portion body 51 of each of the outer wall portions 23 to 26 in the upright state. As shown in FIG. 1, FIG. 2, FIG. 5 and the other drawings, each of the outer wall portions 23 to 26 curves so as to project slightly in an arc shape from inside to outside in plan view in the upright state. In this case, when each of the outer wall portions 23 to 26 in the upright state is viewed substantially in plan, the central section in the length direction of each of the outer wall portions 23 to 26 has a substantial circular arc shape with a relatively large radius (in other words, a substantial circular arc shape having a relatively small curvature), and both end sections in the length direction of each of the outer wall portions 23 to 26 have a substantial circular arc shape with a relatively small radius (in other words, a substantial circular arc shape having a relatively large curvature). Each of the outer wall portions 23 to 26 is a continuous curved body substantially without corner portions from one end section among both of the end sections via the central section to the other end section among both of the end sections.

A height difference H1 (see FIG. 7) in the substantially vertical direction between the upper end of each of the outer wall portions 24 to 26 in the upright state and the upper end of each of the inner wall portions 32 to 34 is about 84.5 mm in the embodiment shown in the drawings. Typically from the standpoint of practical use, the height difference H1 is preferably in the range of 56.3 to 112.7 mm, more preferably in the range of 63.4 to 105.6 mm, and most preferably in the range of 67.6 to 101.4 mm.

4. Operation of Outer Wall Portion Structure

When the foot-side outer wall portion 24 and the left and right outer wall portions 25 and 26 are to be swung forward from the upright state shown in FIG. 1, FIG. 5, and the other drawings, to the downward hanging state exemplified in regard to the outer wall portions 24 and 25 in FIG. 7, first, the operator releases the lock by locking members (i.e., the connecting members 54 and the engaged portions 55) locking each of the outer wall portions 24 to 26 in the returned state. Specifically, when the operator manually lifts the foot-side outer wall portion 24, for example, among the outer wall portions 24 to 26 substantially upward, the bearing member 64 shown in FIG. 2 moves forward inside the bearing guide portion 63*a* of the attachment member 46 from the substantially lower side to the substantially upper side of the guide portion 63*a*, and the connecting member 54 shown in FIG. 2 is pulled out from the engaged portion 55. Next, the operator may swing the outer wall portion 24 forth from the upright state to the downward hanging state by swinging the outer wall portion 24 outward as needed in the substantially opposite direction of the infant accommodation space 27 using the left and right pair of spindle portions 30 as pivot points. The forward (outward) swinging of each of the outer wall portions 24 to 26 may also be configured to happen at a low speed by means of the damping function of dampers (not shown in the drawings) that may control the swinging speed. When swinging the outer wall portions 24 to 26 in the downward hanging state back to the upright state, it suffices for the operator to manually swing the outer wall portions 24 to 26 backward using the pairs of spindle portions 30 of the outer wall portions 24 to 26 as pivot points. Specifically, the operator manually swings the outer wall portion 24, for example, among the outer wall portions 24 to 26 backward using its pair of spindle portions 30 as pivot points. Because of this swinging back, the connecting member 54 shown in FIG. 2 engages with the engaged portion 55 reversely from the case of the forward swinging, and the bearing member (in other words, latch receiving portion) 64 shown in FIG. 2 moves backward inside the bearing guide portion 63*a* from the substantially upper side to the substantially lower side of the guide portion 63*a*.

When the operator manually detaches the foot-side outer wall portion 24, for example, among the outer wall portions 23 to 26, the operator continues to manually move the operable member 45 shown in FIG. 3A and FIG. 4A forward and counter to the spring (that is, the spring engaged with the spring-catching projecting portion 67). Because of this forward moving operation, the spindle portion 30 moves forward through the intermediate state shown in FIG. 3B and FIG. 4B to the state in which it is not engaged with the attachment member 46 (in other words, the state shown in FIG. 3C and FIG. 4C). Thus, the operator may manually pull out the foot-side outer wall portion 24 substantially upward and detach it from the left and right pair of attachment members 46 of the mattress tray 16. Moreover, the operator may reattach the foot-side outer wall portion 24 to the attachment members 46 of the mattress tray 16 as shown in FIG. 2 by performing the reverse operation of that in the case of the pulling-out described above.

Specifically, in the state shown in FIG. 3A and FIG. 4A in which the operable member 45 has not yet been operated (in other words, the engaged state), the lock portion 72 located inside the first open portion 77 of the through hole 76 cannot be moved forward toward the second open portion 78. Therefore, the spindle portion 30 cannot be disengaged from the bearing member 64. Consequently, even if the operator inadvertently touches the knob portion 71, the knob portion 71 does not inadvertently turn because the turn stopper portion 75 is engaged with the second open portion 78 and, therefore, the potential for the operable member 45 to be inadvertently operated is extremely low. When the operator turns the knob portion 71 forward from the engaged state shown in FIG. 3A and FIG. 4A to the intermediate state shown in FIG. 3B and FIG. 4B, it becomes possible for the lock portion 72 to be moved forward to the second open portion 78. Therefore, when the operator linearly moves the knob portion 71 forward (in other words, linearly slides the knob portion 71) to the position shown in FIG. 3C and FIG. 4C counter to the spring, the spindle portion 30 linearly moves forward to the state in which it is not engaged with the attachment member 46. As a result, the spindle portion 30 becomes disengaged from the bearing member 64 and, therefore, the foot-side outer wall portion 24 may be pulled out substantially upward and detached from the attachment member 46.

As shown in FIG. 3A and FIG. 4A, the lock portion 72 of the operable member 45 is configured to be substantially rectangular in shape so that its cross-sectional shape may substantially interiorly contact the inner peripheral surface of the first open portion 77. Therefore, the lock portion 72 may turn only inside the first open portion 77 of the through hole 76. The length of the width of the second open portion 78 that is continuous with the first open portion 77 is substantially equal to the length of the width of the lock portion 72. Therefore, the lock portion 72 that is turnable (in other words, rotatable) inside the first open portion 77 may move to the inside of the second open portion 78 as shown in FIG. 3C and FIG. 4C only when the short edge section of the lock portion 72 is substantially facing (in other words, substantially directly opposing) the second open portion 78. After the foot-side outer wall portion 24 has been attached to the left and right pair of attachment members 46, the left and right pair of spindle portions 30 move backward to the state in which they are engaged with the bearing members 64 disposed in the bearing guide portions 63*a* and 63*b* of the attachment members 46 (i.e., to the state shown in FIG. 3B and FIG. 4B). The knob portion 71 is substantially rectangular in shape in plan view. In the intermediate state shown in FIG. 3B and FIG. 4B in which the operation of turning the operable member 45 backward is not yet complete, the length direction orientation of the knob portion 71 of the operable member 45 differs substantially 90° in comparison to the engaged state shown in FIG. 3A and FIG. 4A. Therefore, the operator may easily see whether or not the operable member 45 is turned back.

In the embodiment shown in the drawings, the spindle portion 30 is configured to be disengaged from the bearing member 64 by turning, from the engaged state (in other words, the latched state) shown in FIG. 3A and FIG. 4A in which the operable member 45 has not yet been operated, the knob portion 71 of the operable member 45 forwardly to the intermediate state shown in FIG. 3B and FIG. 4B and thereafter substantially linearly moving (in other words, substantially linearly sliding) the knob portion 71 of the operable member 45 forth to the non-engaged state shown in FIG. 3C and FIG. 4C. Further, in the embodiment shown in the drawings, the spindle portion 30 is configured to be engaged with the bearing member 64 in a two-stage process by linearly moving (in other words, linearly sliding) the knob portion 71 of the operable member 45 backward from the non-engaged state shown in FIG. 3C and FIG. 4C to the intermediate state shown in FIG. 3B and FIG. 4B and thereafter turning the knob portion 71 of the operable member 45 back to the engaged state shown in FIG. 3A and FIG. 4A. It is also conceivable to configure the knob portion 71 of the operable member 45 so that it goes from the engaged state to the non-engaged state and goes from the non-engaged state to the engaged state by a one-stage process of just linearly moving the knob portion 71 back and forth. However, in the latter case, when an external force or shock not intended by the operator is applied to the operable member 45, there is the concern that the foot-side outer wall portion 24 will be unexpectedly detached from the attachment members 46 (in other words, the mattress tray 16). Thus, there is the potential for the foot-side outer wall portion 24 to fall out from the mattress tray 16, and there is the potential for the foot-side outer wall portion 24 to be damaged. The same also applies to the outer wall portions 23, 25, and 26 other than the foot-side outer wall portion 24. In contrast to this, in the embodiment shown in the drawings, when turning the knob portion 71 of the operable member 45 forward from the engaged state shown in FIG. 3A and FIG. 4A to the intermediate state shown in FIG. 3B and FIG. 4B, the operator needs to tightly take hold of the foot-side outer wall portion 24. Therefore, during the operation of detaching the foot-side outer wall portion 24, there is little concern that by wrongly taking hold of the foot-side outer wall portion 24 the operator will cause the foot-side outer wall portion 24 to fall out and/or damage the foot-side outer wall portion 24.

The head-side outer wall portion 23, the left outer wall portion 25, and the right outer wall portion 26 shown in FIG. 5, FIG. 7 and the other drawings, may be attached to the left and right pairs or front and rear pairs of the attachment members 46 of the mattress tray 16 by means of an attachment structure that is substantially similar or substantially identical to that of the foot-side outer wall portion 24. Therefore, the head-side outer wall portion 23 may be detached from the left and right pair of attachment members 46 of the mattress tray 16 and attached to the left and right pair of attachment members 46 in substantially the same way as in the case already described in regard to the foot-side outer wall portion 24. Moreover, the left outer wall portion 25 and the right outer wall portion 26 may also be attached to the front and rear pairs of attachment members 46 of the mattress tray 16 by means of an attachment structure that is substantially similar or substantially identical to that of the foot-side outer wall portion 24.

FIG. 6 shows an infant accommodation mechanism 81 in a different state from that of an infant accommodation mechanism 81 shown in FIG. 5. In the infant accommodation mechanism 81 shown in FIG. 6, the head-side outer wall portion 23 and the foot-side outer wall portion 24 of the infant accommodation mechanism 81 shown in FIG. 5 have been interchanged with each other. When doing this interchanging, first, the operator may detach the head-side outer wall portion 23 and the foot-side outer wall portion 24 by performing a detachment operation that is substantially identical to that of the detachment already described in regard to the foot-side outer wall portion 24. Next, the operator may attach the head-side outer wall portion 23 as shown in FIG. 6 to the left and right pair of attachment members 46 to which the foot-side outer wall portion 24 had been attached as shown in FIG. 5, and may attach the foot-side outer wall portion 24 as shown in FIG. 6 to the left and right pair of attachment members 46 to which the head-side outer wall portion 23 had been attached as shown in FIG. 5.

In the infant accommodation mechanism 81, as shown in FIG. 1, FIG. 5, and FIG. 6, the head-side outer wall portion 23 and the foot-side outer wall portion 24 may be interchanged with each other. In the infant accommodation mechanism 81, normally the head-side outer wall portion 23 equipped with the cutout-like recess portion 31 and the grommet members 42 is located adjacent to the accessory support column 22 as shown in FIG. 1 and FIG. 5. Furthermore, in the normal use state shown in FIG. 1 and FIG. 5, the infant's head may be placed adjacent to the vicinity of the inner side of the head-side outer wall portion 23 and the infant's legs (particularly the feet) may be placed adjacent to the vicinity of the inner side of the foot-side outer wall portion 24. Consequently, in the normal use state, a breathing tube (not shown in the drawings) from a resuscitation device (not shown in the drawings) may extend through the grommet members 42 of the head-side outer wall portion 23 to the vicinity of the mouth of the infant. However, when a doctor or nurse administers some type of care to the vicinity of the head of the infant in the normal use state, it is necessary for the doctor or nurse to administer the care from the vicinity of the support column 22 to the vicinity of the head of the infant because the support column 22 is present. In the normal use state shown in FIG. 1 and FIG. 5, it is also conceivable for the doctor or nurse to administer a care to the vicinity of the head of the infant by switching the head side and the foot side of the infant with each other. However, in this case, the breathing tube from the resuscitation device extends a relatively long distance from the grommet members 42 of the head-side outer wall portion 23 to the vicinity of the head of the infant. Therefore, the breathing tube may be twisted and/or bent as a result of the infant moving his/her body, and it may be difficult for the air for breathing to be well supplied from the breathing tube to the infant.

In contrast, when the head-side outer wall portion 23 and the foot-side outer wall portion 24 are interchanged with each other as shown in FIG. 6, the head-side outer wall portion 23 is positioned away from the support column 22. Therefore, regardless of the presence of the support column 22, the doctor or nurse may move closer to the vicinity of the head of the infant located in a position away from the support column 22. In this case, the breathing tube may be passing through the grommet member 42 after being routed through the vicinity of the outer peripheral surface of the left or right outer wall portion 25 or 26. Consequently, there is virtually no concern that the breathing tube will be twisted and/or bent as a result of the infant moving his/her body. Moreover, the left outer wall portion 26 and the right outer wall portion 27 may also be interchanged with each other as needed. When at least one outer wall portion among the head-side outer wall portion 23, the foot-side outer wall portion 24, the left outer wall portion 25, and the right outer wall portion 26 is damaged, the at least one outer wall portion 23, 24, 25, or 26 may also be replaced with a spare outer wall portion.

It is conceivable not only to equip the head-side outer wall portion 23 with the grommet members 42 and the cutout-like recess portion 31 as shown in FIG. 1, FIG. 5 and the other drawings, but also to similarly equip the foot-side outer wall portion 24 with the grommet members 42 and the cutout-like recess portion 31. However, if both of the outer wall portions 23 and 24 are equipped with the grommet members 42 and the cutout-like recess portion 31, there are cases in which the grommet members 42 and the cutout-like recess portion 31 disposed in the foot-side outer wall portion 24 may be a nuisance to the doctor or nurse. In addition, the cost for disposing two sets each of the grommet members 42 and the cutout-like recess portion 31 will be relatively high. In contrast, in the embodiment shown in the drawings, as shown in FIG. 5 and FIG. 6, one of the head-side outer wall portion 23 and the foot-side outer wall portion 24 (namely, the head-side outer wall portion 23) is equipped with the cutout-like recess portion 31 and the grommet members 42. Therefore, in the case of the embodiment shown in the drawings, the four outer wall portions 23 to 26 may be provided relatively inexpensively in comparison to the case of equipping both the head-side outer wall portion 23 and the foot-side outer wall portion 24 with the cutout-like recess portion 31 and the grommet members 42.

An embodiment of the disclosure has been described in detail above, but the disclosure is not limited to this embodiment and may be changed and modified in various ways on the basis of the spirit of the disclosure as defined in the claims.

For example, in the embodiment, the disclosure is applied to an open type incubator. However, the disclosure may be applied not only to an open type incubator but also to an open type incubator doubling as a closed type. In this case, a substantially box lid-like top hood that may selectively cover the infant accommodation space 27 from above and may be moved substantially up and down may be disposed. The top hood may include a top portion, which may be substantially transparent, and an upper wall portion, which projects substantially downward from the vicinity of the outer periphery of the top portion and may be substantially transparent and is substantially rectangular in shape when viewed in plan. The incubator may be configured such that when the top hood is lifted the incubator being an open type incubator as a result of the upper surface of the infant accommodation space 27 being opened, and when the top hood is lowered the incubator being a closed type incubator as a result of the upper surface of the infant accommodation space 27 being closed.

Furthermore, in the embodiment, the mattress tray 16 is configured to have a substantial rectangular shape in plan view. However, the mattress tray 16 may also be configured to have a substantial circular shape, a substantial elliptical shape, or a substantial rectangular shape with semicircular ends in plan view, or may also be configured to have a substantial polygonal shape other than a substantial rectangular shape.

What is claimed is:

1. An incubator comprising:

a mattress tray;

an incubator base on which the mattress tray is disposed;

a plurality of baby guards that stand to surround an outer periphery of the mattress tray, at least one of the plurality of baby guards configured to be removable from the incubator base;

a latch receiving hole formed in one of the incubator base or the at least one removable baby guard;

a latch rod provided in the other of the incubator base or the at least one removable baby guard for slidable movement along an axial direction of the latch rod between a latched position where the latch rod is received in the latch receiving hole to keep the at least one removable baby guard attached to the incubator base and a released position where the latch rod is out of the latch receiving hole to allow the at least one removable baby guard to be removed from the incubator base;

a latch releasing mechanism comprising a stopper connected to the latch rod and a passage formed along the axial direction of the latch rod, wherein the stopper and the passage are configured such that the stopper is prevented from entering the passage when the stopper is placed at a first angular position, whereas the stopper is allowed to enter the passage and travel along inside the passage when the stopper is placed at a second angular position; and a rotatable lever operably connected to the stopper to rotate the stopper between the first and second angular positions, wherein the lever is operable to rotate the stopper from the first angular position to the second angular position and further operable to move the stopper along inside the passage to thereby move the latch rod in the axial direction from the latched position to the released position.

2. The incubator according to claim 1, wherein the rotatable lever is provided at the at least one removable baby guard.

3. The incubator according to claim 1, wherein the at least one removable baby guard is configured such that when the latch rod is at the latched position, the at least one removable baby guard is able to individually swing back and forth about the latch rod between an upright position and a downward position.

4. The incubator according to claim 1, wherein the at least one removable baby guard comprises a first baby guard that includes a grommet portion, the first baby guard removably attached to a first attachment place in the outer periphery of the mattress tray, the at least one removable baby guard comprises a second baby guard removably attached to a second attachment place in the outer periphery of the mattress tray, the first baby guard is further configured attachable to the second attachment place, and the second baby guard is further configured attachable to the first attachment place.

5. The incubator according to claim 4, wherein the at least one removable baby guard comprises a front baby guard configured as the second baby guard, a rear baby guard configured as the first baby guard, a left baby guard, and a right baby guard.

6. The incubator according to claim 1, wherein the at least one removable baby guard forms an infant accommodation space that is substantially rectangular.

7. The incubator according to claim 1, wherein the incubator is an open type incubator.

* * * * *